United States Patent [19]

Merritt

[11] Patent Number: 4,648,515

[45] Date of Patent: Mar. 10, 1987

[54] LOOSELEAF BINDER HOLDER

[76] Inventor: Vernon L. Merritt, 10907 Keese, P.O. Box 34351, Houston, Tex. 77034

[21] Appl. No.: 504,957

[22] Filed: Jun. 16, 1983

[51] Int. Cl.[4] ..... A47F 7/00

[52] U.S. Cl. ..... 211/43; 108/61; 211/184

[58] Field of Search ..... 211/184, 43, 175; 108/61

[56] References Cited

U.S. PATENT DOCUMENTS

| | | | |
|---|---|---|---|
| 1,506,204 | 8/1924 | Snoddy | 211/43 |
| 1,593,326 | 7/1926 | Bourn | 211/10 X |
| 3,494,583 | 2/1970 | Pan | 248/125 X |
| 3,844,415 | 10/1974 | Heimann | 211/184 X |
| 3,905,484 | 9/1975 | Dean et al. | 211/184 |
| 4,319,688 | 3/1982 | Wahl | 211/175 |
| 4,327,838 | 5/1982 | Cooke | 108/61 X |
| 4,428,136 | 1/1984 | Franklin | 211/175 X |
| 4,484,685 | 11/1984 | Williams | 211/10 X |

FOREIGN PATENT DOCUMENTS

| | | | |
|---|---|---|---|
| 2451785 | 11/1980 | France | 211/184 |

*Primary Examiner*—Robert W. Gibson, Jr.
*Attorney, Agent, or Firm*—Kenneth A. Roddy

[57] ABSTRACT

A looseleaf binder holder for receiving and supporting looseleaf binders in an upright position on flat horizontal surfaces comprises a collapsible frame and a plurality of removable dividers slidably received on the frame in adjustable laterally spaced relation for receiving and supporting looseleaf binders in an upright position. The rear wall of the frame is a flat rectangular plate member. A pair of opposed angular side members having a flat rectangular side portion and an adjoining flat rectangular rear portion are releasably attached to the lateral sides of the rectangular plate member. The rear portions of the side members serve as an extension of the rear wall of the frame and the side portions extend angularly outward therefrom when attached to the rectangular plate member sufficient to support the frame in a generally vertical position upon a flat horizontal surface. Each divider is a flat V-shaped member having two leg portions converging at one end forming the apex and the opposed diverging ends have depending hooks at their back end to be slidably received on the top edge of the frame. The legs of each divider flex laterally sufficient to accommodate looseleaf binders of various shape and thickness between adjacent dividers according to their fill of pages.

12 Claims, 3 Drawing Figures

LOOSELEAF BINDER HOLDER

BACKGROUND OF THE INVENTION

This invention relates generally to storage racks, and more specifically to a portable, collapsible looseleaf binder holder for storing looseleaf binders.

The difficulty of storing looseleaf binders in a readily accessible upright position upon a desk or table is well known. Unless packed tightly next to each other, they may fall over and thus they are obliged to be kept piled one on top of another. This situation is, accordingly in need of an improvement.

SUMMARY OF THE INVENTION

It is therefore a principle object of the present invention to provide a holder for supporting looseleaf binders in an upright stored position upon a desk or table.

Another object of this invention is to provide a looseleaf binder holder which is collapsible, so as to be easily and quickly erected on a desk or table without the necessity of permanent securement to the desk, and which is easily dissassembled to be readily portable for removal and erection elsewhere.

Another object of this invention is to provide a looseleaf binder holder which is particularly useful upon a library tables, school desks, and office desks or tables.

A further object of this invention is to provide a looseleaf binder holder which is easy and efficient in use, simple in design, inexpensive to manufacture, and rugged in construction.

These and other objects of the invention will be readily evident upon a study of the following specification and accompanying drawings.

DESCRIPTION OF THE PREFERRED EMBODIMENT

Figure 1:
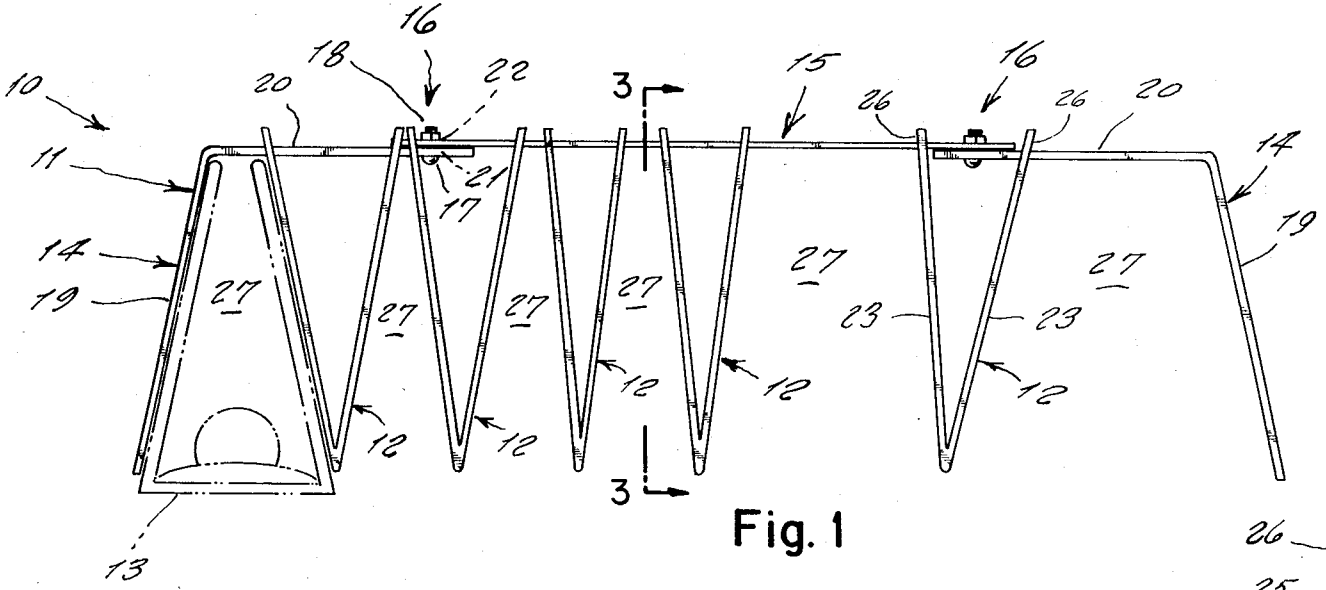
FIG. 1 is a top plan view of the present looseleaf binder holder shown in use.
Figure 3:
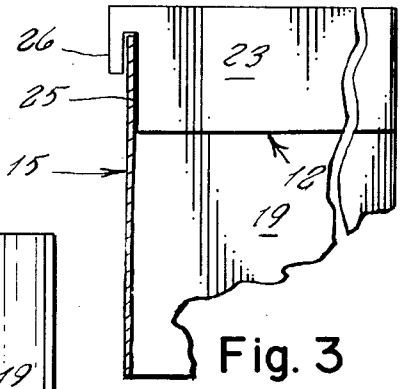
FIG. 3 is a fragmentary cross-sectional view of the looseleaf binder holder taken along line 3—3 of FIG. 1.
Figure 2:
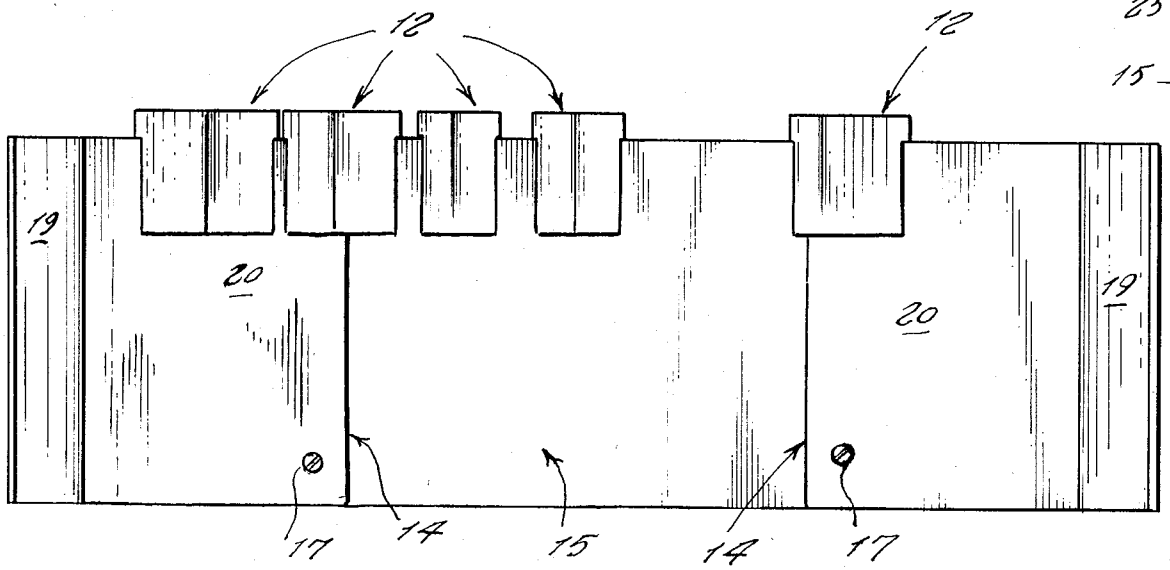
FIG. 2 is a front elevational view of the looseleaf binder holder.

Referring to the drawings by numerals of reference, there is shown a preferred looseleaf binder holder 10, in accordance with the present invention. The holder 10 comprises a collapsible rack or frame 11 having a plurality of removable dividers 12 slidably received thereon to serve as supporting partitions for receiving and supporting looseleaf binders 13 in an upright position in the holder.

The rack or frame 11 comprises a pair of opposed end members 14, attached to each lateral end of a rectangular plate or expansion member 15 centrally disposed therebetween. The end members 14 are removably attached to the expansion member by fasteners 16, such as a short bolt 17 fitted with a cap nut 18. The end members 14 and the expansion member 15 are preferably made of a rigid plastic material, in order be produced inexpensively in mass production and in various colors to suit any room decor. The plastic material also allows the holder 10 to be easily cleaned and gives an attractive appearance.

Each end member 14 is generally angular in shape having a flat rectangular side portion 19 and an adjoining flat rectangular rear portion 20. A pair of vertically spaced holes 21 are provided near the side edge of the rear portion 20 of each end member 14 and another pair of vertically spaced holes 22 are provided near each lateral side edge of the expansion member 15 in alignment with the holes 21 of the end members 14. The bolts 17 are received through the holes 21 and 22 and cap nuts 18 are threaded thereon to secure the end members to the expansion member 15 to form an elongated rear wall. It should be understood that the expansion member 15 may be made expandible in length.

Each of the dividers 12 is preferably molded of the same rigid plastic material as the expansion member 15 and the end members 14. Each divider 12 consists of a flat V-shaped member having two leg portions 23 converging at one end at the apex 24 and the opposed diverging ends 24 are each provided with a hook 26 depending from the upper corner thereof. The hook 26 is slidably received on the top edge of the expansion member 15 and end members 14. The divider legs 23 may flex laterally sufficient to accomodate looseleaf binders of various shape according to their fill of pages.

While the present looseleaf binder holder is not limited to any particular dimensions, a suggested practical size for the end members 14 is six in height with the rear portion 20 three and one-half inches long and the side portion 19 ten inches long. A practical size for the expansion member 15 is six inches in height and eight inches long. A suggested size for each V-shaped divider 12 would be two inches in height and ten inches long with a distance of two inches between the hooks 26.

The looseleaf binder holder may be sold in an unassembled or "knock-down" condition as a kit of parts to be assembled by the purchaser, and may include three or more dividers.

In use, the side members 14 are placed with the rear portions 20 overlapping the lateral side edges of the expansion member 15 with the holes 21 and 22 in alignment. The bolts 17 are inserted through the holes, and the side members 14 are secured to the expansion member 15 threading the cap nuts 18 onto the bolts 17. The dividers 12 are simply hooked over the rear top edge of the assembled frame 11, so as to form the spaces 27, into which the looseleaf binders 13 are fitted. By sliding the dividers 12 laterally on the frame, the width of the spaces may be adjusted to accomodate the thickness of the binders. The divider legs 23 may flex laterally sufficient to accomodate looseleaf binders of various shape according to their fill of pages.

While various changes may be made in the detail construction, it is understood that such changes will be within the spirit and scope of the present invention as defined by the appended claims.

What I now claim is:

1. A looseleaf binder holder comprising;

a collapsible frame having a flat rectangular rear portion and laterally opposed angular side members which support said frame in a generally vertical position upon a flat horizontal surface, and a plurality of removable dividers adapted to be slidably received on an upper edge of the rear portion of said frame in adjustable laterally spaced relation for receiving and supporting looseleaf binders in an upright position therebetween.

2. The looseleaaf binder holder according to claim 1 wherein said side members are releasably attached one at each lateral end of said rear portion.

3. The looseleaf binder holder according to claim 2 wherein said rear portion is a flat rectangular plate member having a series of vertically spaced holes near each lateral side edge, each said side member is generally angular in shape having a flat rectangular side portion and an adjoining flat rectangular rear portion with a series of vertically spaced holes near the side edge thereof in alignment with said holes of said side member, and attaching means received in said holes for releasably attaching said side members to said rectangular plate member, said side member side portions extending angularly outward relative to rectangular plate member sufficient to support said rectangular plate member in a generally vertical position upon a flat horizontal surface.

4. The looseleaf binder holder according to claim 3 wherein said attachment means comprises a plurality of bolts and cap nuts.

5. The looseleaf binder holder according to claim 1 wherein each said divider is a flat V-shaped member having two leg portions converging at one end forming the apex and the opposed diverging ends adapted at their back end to be slidably received on said frame.

6. The looseleaf binder holder according to claim 5 wherein said diverging ends of said leg portions provided with a depending hook at their back end to be slidably received on the top edge of said frame.

7. The looseleaf binder holder according to claim 5 wherein said divider legs of each divider flex laterally sufficient to accomodate looseleaf binders of various shape and thickness between adjacent divider according to their fill of pages.

8. A kit of materials in knock-down form to be assembled into a holder for looseleaf binders comprising;

a flat rectangular plate member having a series of vertically spaced holes near each lateral side edge to serve as the rear wall for said holder, a pair of angular side members having a flat rectangular side portion and an adjoining flat rectangular rear portion with a series of vertically spaced holes near the side edge thereof in alignment with said holes of said rectangular plate member, attaching means to be received in said holes for releasably attaching said side members to said rectangular plate member, said rear portions of said members to serve as an extension of the rear wall of said holder and said side portions of said side members extending angularly outward therefrom when attached to said rectangular plate member sufficient to support said rectangular plate member in a generally vertical position upon a flat horizontal surface, and a plurality of removable dividers adapted to be slidably received on said rear wall of said holder in adjustable laterally spaced relation for receiving and supporting looseleaf binders in an upright position therebetween.

9. The kit of materials according to claim 8 wherein said attachment means comprises a plurality of bolts and cap nuts.

10. The kit of materials according to claim 8 wherein each of said divider is a flat V-shaped member having two leg portions converging at one end forming the apex and the opposed diverging ends adapted at their back end to be slidably received on said rear wall of said holder.

11. The kit of materials according to claim 10 wherein said diverging ends of said leg portions provided with a depending hook at their back end to be slidably received on the top edge of the rear wall of said holder.

12. The kit of materials according to claim 10 wherein said divider legs of each divider flex laterally sufficient to accomodate looseleaf binders of various shape and thickness between adjacent dividers according to their fill of pages.

* * * * *